United States Patent [19]

Primich

[11] 4,403,732

[45] Sep. 13, 1983

[54] ENERGY SAVING HEAT RECYCLING SYSTEM

[76] Inventor: Theodore Primich, 4400 W. 9th Ave., Gary, Ind. 46406

[21] Appl. No.: 178,982

[22] Filed: Aug. 18, 1980

[51] Int. Cl.[3] ..... F24D 5/00

[52] U.S. Cl. ..... 237/50; 98/33 A; 98/DIG. 7; 138/174

[58] Field of Search ..... 98/33 A, DIG. 7; 138/174; 237/50

[56] References Cited

U.S. PATENT DOCUMENTS

| | | | |
|---|---|---|---|
| 2,348,455 | 5/1944 | Daudelin | 98/DIG. 7 |
| 3,501,173 | 3/1970 | Peterson et al. | 285/114 |
| 3,827,342 | 8/1974 | Hughes | 98/33 A |
| 3,973,479 | 8/1976 | Whitely | 98/33 A |
| 4,053,732 | 10/1977 | Carter | 98/33 A |
| 4,184,415 | 1/1980 | Nicholson | 98/33 A |
| 4,185,545 | 1/1980 | Rusth et al. | 98/33 A |

*Primary Examiner*—Ronald C. Capossela

[57] ABSTRACT

An energy saving heat recycling system for circulating hot air from the upper portion of a building, near the roof, to the lower portion of the building, near the floor level, to reuse the hot air to heat the lower portion of the building, such system comprising a generally cylindrical supporting sleeve, an electric fan including a fan motor mounted within the sleeve and a fan rotor to be rotated by the motor within the sleeve, means for mounting the sleeve in the upper portion of the building whereby the electric fan is to draw hot air into the intake end of the sleeve while discharging the hot air from the discharge end of the sleeve, and a flexible tubular duct connected to the discharge end of the sleeve for conveying the hot air to the lower portion of the building near the floor level, the duct being in the form of a tube made of thin flexible material which is compactly foldable for storage and shipment and is readily capable of being bent around obstructions and threaded through openings in the building. A clamping band may be employed to clamp the tubular duct around and against the discharge end of the sleeve. A thermostatic switch is preferably provided to energize the fan motor automatically, when the temperature of the air to be drawn into the fan exceeds a predetermined value.

9 Claims, 6 Drawing Figures

THERMOSTAT
FAN MOTOR
115V.

ENERGY SAVING HEAT RECYCLING SYSTEM

This invention relates to an energy saving heat recycling system, which will find various applications, but is particularly well adapted for circulating hot air from the upper portion of a building, near the roof, to a lower portion of the building, near the floor level, so that the hot air is reused for heating the lower portion of the building.

The invention is particularly well adapted for use in industrial buildings and other buildings in which the building is open between the roof and the floor level. It has been found that during the colder winter days of the heating season, the air in the upper portion of an industrial building, just under the roof, becomes quite hot, perhaps between 85 and 90 degrees Fahrenheit, while the lower portion of the building rmains quite cool, perhaps 60° F. The temperature gradient between the floor and the roof may range from one half to one degree per foot, or even more. The hot air just under the roof increases the heat loss from the building through the roof. Moreover, the hot air near the roof is of no value in accomplishing the desired purpose of heating the lower portion of the building, near the floor level, where a comfortably warm temperature is needed.

The principal object of the present invention is to provide a new and improved energy saving heat recycling system for circulating the hot air from the upper portion of a building, near the roof, to the lower portion of the building, near the floor level, for reuse in heating the lower portion of the building.

A further object is to provide such a system which is extremely low in cost and very easy to install.

Another object is to provide such a system which operates under automatic control.

A further object is to provide such a system which can be shipped and stored very compactly.

To achieve these and other objects, the present invention preferably provides an energy saving heat recycling system for circulating hot air from the top portion of a building to the lower portion of the building, near the floor level, such system comprising a fan housing an electric fan mounted in the housing and comprising an electric motor securd to the housing and a fan rotor driven by the motor and rotatable within the housing, such housing having an intake opening into which air is to be drawn by the fan and a discharge opening from which air is to be discharged by the fan, such housing being capable of being mounted in the top portion of the building from which hot air is to be drawn by the fan into the intake opening, and a flexible tubular duct connected to the discharge opening of the housing to convey the hot air to the lower portion of the building near the floor level so that the hot air is reused to heat the lower portion of the building, such duct being in the form of a tube made of thin flexible material which is compactly foldable for storage and shipment and which makes it possible to bend and thread the duct around obstructions and through openings.

The system preferably includes a clamping band for clamping one end of the flexible duct around and against the outside of the housing, which is preferably in the form of a cylindrical sleeve.

The system also preferably comprises an electrical energizing circuit connected to the fan motor and including a thermostatic switch for energizing the motor when the air temperature exceeds a predetermined value so that the electric fan will be started automatically when the air to be drawn into the housing is sufficiently hot.

Further objects, advantages and features of the present invention will appear from the following description, taken with the accompanying drawings, in which.

Figures 1, 2, 3, 4, 5, 6:
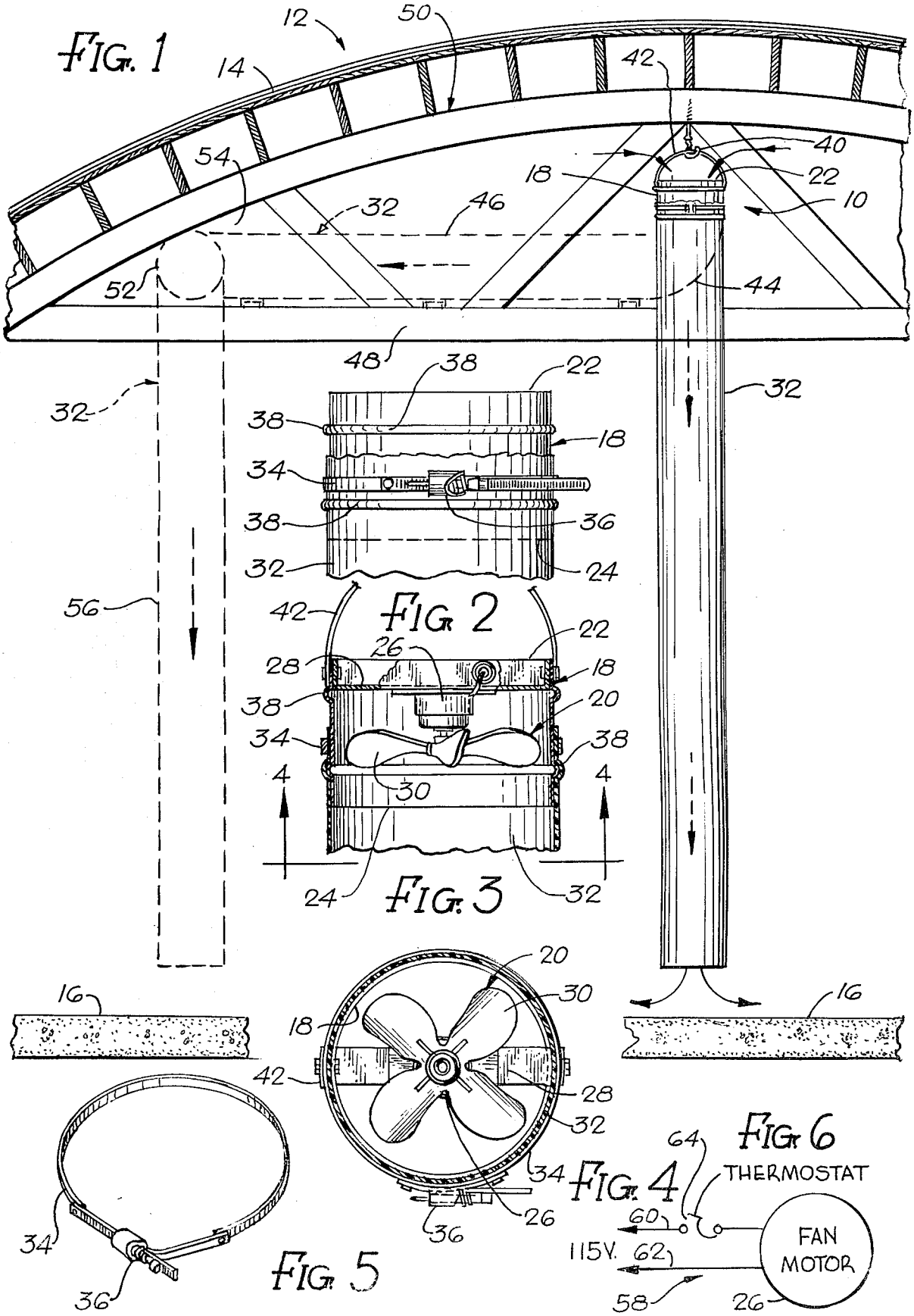
FIG. 1 is a fragmentary elevational section, showing an energy saving heat recycling system, to be described as an illustrative embodiment of the present invention, the system being shown in its position of use, within an industrial building, which is shown in fragmentary section.
FIG. 2 is a fragmentary enlarged elevation, showing the upper portion of the system.
FIG. 3 is a fragmentary elevational section showing the upper portion of the system.
FIG. 4 is a horizontal section, taken as indicated by the line 4—4 in FIG. 3.
FIG. 5 is a perspective view of a clamping band, employed in the system to secure the flexible duct to the supporting sleeve.
FIG. 6 is a schematic electrical circuit diagram for the heat recycling system.

As just indicated, FIG. 1 illustrates an energy saving heat recycling system 10, installed in a building 12 having a roof 14 and a floor 16. The building 12 is of an industrial type which is open between the inside of the roof 14 and the floor. The heat recycling system 10 is particularly well adapted for use in such buildings.

As shown in FIGS. 1–4, the heat recycling system 10 comprises a generally cylindrical supporting sleeve 18 which may be made of sheet metal or some other material capable of providing sufficient rigidity. An electric fan 20 is mounted within the sleeve 18 and is adapted to draw air into the intake end 22 of the sleeve 18, while discharging the air from the discharge end 24 of the sleeve. The electric fan 20 comprises a fan motor 26, secured to the inside of the sleeve 18 by one or more supporting members 28. The fan motor 26 is adapted to drive a fan rotor 30 which is rotatable within the sleeve 18.

A flexible tubular duct 32 is connected to the discharge end 24 of the supporting sleeve 18, for conveying air to a desired remote location. The duct 32 is preferably in the form of a tube made of a thin, flexible material, such as laminated aluminum or some other metal foil, which may be reinforced with crisscrossing cords arranged in a mesh or grid pattern.

As shown in FIGS. 1–5, a clamping band 34 is preferably employed for clamping the duct 32 around and against the discharge end 24 of the sleeve 18. A screw fastener 36 may be employed for tightening and loosening the clamping band 34. It will be seen that the sleeve 18 is formed with a pair of outwardly projecting annular beads or ridges 38 which assist in retaining the tubular plastic duct 32 in its clamped position around the sleeve 18. The beads 38 also increase the rigidity of the sleeve 18.

As shown in FIG. 1, means are provided for mounting the recycling system 10 in the building 12 with the intake end 22 of the sleeve 18 in the upper portion of the building 12, preferably just under the roof 14, where the air in the building will be the hottest. As shown, the sleeve 18 is suspended from a hook or hanger 40, secured to one of the structural members of the building 12, under the roof 14. The sleeve 18 is provided with a bail 42 which is connected to diametrically opposite points on the sleeve, at the intake end 22 thereof and is suspended from the hook 40.

The flexible duct 32 may simply be allowed to hand directly downwardly from the sleeve 18, as shown in full lines in FIG. 1, so that the duct will convey the hot air, circulated by the electric fan 20, downwardly to the lower portion of the building 12, near the level of the floor 16. The hot air discharged from the lower end of the duct 32 is useful in heating the lower portion of the building, where a comfortably warm temperature is needed for the benefit of persons occupying the building. The flexible duct 32 can easily be cut to the desired length with ordinary scissors, because the duct 32 is made of a thin material which is easily cut. As previously indicated, the duct 32 is preferably made of laminated reinforced metal foil. Other possible materials are plastic film or various fabrics. When the electric fan 20 is running, the air delivered by the fan inflates the flexible duct 32, so that it is kept in a cylindrical shape.

If desired, the flexible duct 32 can easily be bent around obstructions, and can readily be threaded through openings in the building 12, as illustrated in broken lines in FIG. 1. Such broken lines represent a changed position of the duct 32. In such changed position, the duct 32 is bent laterally, a short distance below the discharge end 24 of the sleeve 18, the bent portion of the duct 32 being designated 44. The duct 32 then has a horizontal portion 46 extending along a structural member 48 of the building 12, such member 48 being shown as the lower member of a roof supporting truss 50. Next, the duct 32 has a bent portion 52 which is threaded through an opening 54 in the truss 50. Finally, the duct 32 has a portion 56 which extends downwardly to the lower portion of the building 12 near the level of the floor 16. Here again, the operation of the electric fan 20 produces a flow of air through the duct 32, so as to keep the duct inflated.

It is preferred to provide means for automatically energizing the electric fan motor 26 when the termperature of the air near the intake end 22 of the sleeve 18 exceeds a predetermined value, such as 75 or 80 degrees Fahrenheit. In this way, the electric fan 20 operates automatically without any attention. The fan 20 is energized whenever the air to be drawn into the sleeve 18 is sufficiently hot to warrent the circulation of the hot air to the lower portion of the building.

As shown in FIG. 6, the fan motor 26 is provided with an electrical energizing circuit 58, whereby the motor 26 is energized from a pair of electrical power lines 60 and 62, which may constitute a supply of alternating current at 115 volts and 60 cycles per second, or any other suitable voltage and frequency. A thermostatic switch 64 is connected in series with one of the supply lines 60 and 62, extending to the motor 26. The thermostatic switch 64 may be constructed and adjusted so as to close when the temperature of the air around the switch exceeds a predetermined value, which may be adjustable.

Due to the provision of the thermostatic switch 64, the fan motor 26 can be wired directly into one of the electrical circuits in the building 12, without any need for a manually operable switch other than the usual circuit breaker or shut-off switch at the electrical control panel for the building.

The flexible duct 32 can be folded very compactly when it is desired to store or ship the recycling system 10. Thus, the entire recycling system 10 can be packed very compactly in a small carton or other container, for shipment and storage.

The operation of the recycling system 10 recirculates the hot air from the upper portion of the building 12, just under the roof 14 to the lower portion of the building, near the floor level 16, where the hot air is useful for heating the lower portion of the building to a comfortable temperature. Thus, the recycling system 10 results in the conservation of heat energy which otherwise would be wasted. The recycling system 10 also reduces the temperature of the air under the roof 14, so that less heat is lost to the outside of the building through the roof. This is an important factor in conserving energy because it has been found that most of the heat loss from an industrial building is through the roof.

Various modifications, alternative constructions and equivalents may be employed, without departing from the true spirit and scope of the present invention, as exemplified in the foregoing description and defined in the following claims.

I claim:

1. An energy saving heat recycling system for circulating hot air from the top portion of a building to the lower portion of the building near the floor level, said system comprising a generally cylindrical supporting sleeve, a fan assembly having an electric motor with a rotatable shaft and a fan blade mounted on the shaft, said fan assembly being on a bracket and the bracket being mounted on said sleeve, the fan blade being rotatably disposed within said sleeve, said sleeve having an intake end into which air is to be drawn by said fan and a discharge end from which air is to be discharged by said fan, said sleeve being capable of being mounted in the top portion of a building from which hot air is to be drawn by said fan into said intake end of said sleeve, and a flexible tubular duct connected to said discharge end of said sleeve to convey the hot air to the lower portion of the building near the floor level so that the hot air is reused to heat the lower portion of the building, said duct being in the form of a tube made of thin flexible material which is compactly foldable for storage and shipment and which makes it possible to bend and thread said duct around obstructions and through openings.

2. A system according to claim 1, including a clamping band for clamping one end of said flexible duct around and against the outside of said sleeve to connect said duct to said sleeve.

3. A system according to claim 1, in which said thin flexible material comprises metal foil.

4. A system according to claim 1, in which said thin flexible material comprises laminated reinforced metal foil.

5. A system according to claim 1, in which said thin flexible material comprises metal foil laminated with reinforcing cords.

6. A system according to claim 1, comprising an electrical energizing circuit connected to said motor, said circuit including a thermostatic switch for energizing said motor when the air temperature exceeds a predetermined value so that the electric fan will be started automatically when the air to be drawn into said sleeve is sufficiently hot.

7. A system according to claim 1, including a clamping band for clamping one end of said flexible duct around and against the outside of said sleeve to connect said duct to said sleeve, said sleeve having an outwardly projecting annular bead to cooperate with said clamping band in retaining said flexible duct on said sleeve.

8. An energy saving heat recycling system for circulating hot air from the upper portion of a building to the lower portion of the building near the floor level, said system comprising a fan housing, an electric fan mounted within said housing and comprising an electric motor secured to said housing and a fan rotor driven by said motor and rotatable within said housing, said housing having an intake opening into which air is to drawn by said fan and a discharge opening from which air is to be discharged by said fan, said housing being capable of being mounted in the upper portion of a building from which hot air is to be drawn by said fan, and a flexible tubular duct connected to said discharge opening of said housing to convey the hot air to the lower portion of the building near to the floor level so that the hot air is reused to heat the lower portion of the building, said duct being in the form of a tube made of thin flexible metal foil which is compactly foldable for storage and shipment and which makes it possible to bend and thread said duct around obstructions and through openings.

9. A system according to claim 8 wherein the thin flexible metal foil is laminated with reinforcing cords.

* * * * *